United States Patent [19]

Roberts et al.

[11] 4,257,919

[45] Mar. 24, 1981

[54] METHOD OF TRANSFERRING A PASSIVATING AGENT TO OR FROM A CRACKING CATALYST

[75] Inventors: John S. Roberts; Dwight L. McKay; Brent J. Bertus; H. Wayne Mark, all of Bartlesville, Okla.

[73] Assignee: Phillips Petroleum Company, Bartlesville, Okla.

[21] Appl. No.: 90,182

[22] Filed: Nov. 1, 1979

[51] Int. Cl.[3] ..... B01J 23/14; B01J 23/18

[52] U.S. Cl. ..... 252/461; 252/411 R; 252/455 Z; 252/456; 208/113; 208/120

[58] Field of Search ..... 252/411 R, 456, 461, 252/455 Z; 208/113, 120

[56] References Cited

U.S. PATENT DOCUMENTS

| | | | |
|---|---|---|---|
| 2,488,718 | 11/1949 | Forrester | 208/113 |
| 3,120,484 | 2/1964 | Mills et al. | 252/411 R |
| 3,151,088 | 9/1964 | Sanford et al. | 252/416 |
| 3,506,409 | 4/1970 | Hutson, Jr. et al. | 252/411 R |
| 3,524,822 | 8/1970 | Frankovich et al. | 252/416 |
| 4,111,845 | 9/1978 | McKay | 252/455 Z |
| 4,148,714 | 8/1979 | Nielsen et al. | 208/114 |
| 4,153,536 | 5/1979 | McKay | 208/120 |

*Primary Examiner*—Carl F. Dees

[57] ABSTRACT

A passivating agent is added to a cracking catalyst which has not been previously treated with the passivating agent by mixing the untreated cracking catalyst with a refractory material which has been previously treated with a passivating agent. At least a portion of the passivating agent is transferred by inter-particle transfer from the treated refractory material to the untreated cracking catalyst.

A passivating agent may also be recovered from a previously treated cracking catalyst which has become contaminated by contacting the contaminated cracking catalyst with a refractory material which has not previously been treated with the passivating agent. At least a portion of the passivating agent will transfer by inter-particle transfer from the contaminated catalyst to the refractory material while the contaminants on the contaminated cracking catalyst will not transfer.

20 Claims, No Drawings

METHOD OF TRANSFERRING A PASSIVATING AGENT TO OR FROM A CRACKING CATALYST

This invention relates to a method for adding a passivating agent to a cracking catalyst. In another aspect this invention relates to a method for recovering a passivating agent from a cracking catalyst which has become contaminated.

Hydrocarbon feedstocks containing higher molecular weight hydrocarbons are commonly cracked by contacting the hydrocarbon feedstocks at an elevated temperature with a cracking catalyst whereby distillates such as gasoline and higher-boiling hydrocarbon fuels are produced. However, the cracking catalyst gradually deteriorates during this process. One reason for this deterioration is the deposition of contaminating metals such as nickel, vanadium, iron, copper and cobalt on the catalyst. These contaminating metals result in an increased production of hydrogen and coke and a decreased catalyst activity for cracking. Furthermore, the conversion of hydrocarbons into gasoline and higher-boiling hydrocarbon fuels is reduced by these contaminants.

Efforts have been made to mitigate these detrimental effects by passivating these metals. Metals such as antimony, tin, indium, bismuth, and compounds thereof have been proposed for passivating the metal contaminants.

A number of methods have been proposed for adding passivating agents to the cracking catalyst. Previously disclosed methods include the addition of the passivating agents as finely divided solids to the cracking catalyst followed by mixing, impregnation of the catalyst before use with a solution containing the passivating agent, and addition of the agent to the catalyst via the hydrocarbon-containing feedstock. It is an object of this invention to provide a novel method for adding a passivating agent to a cracking catalyst which may present advantages over the prior art methods under particular process situations.

The treatment of the cracking catalyst with a passivating agent does not prevent contamination of the cracking catalyst with metals such as nickel, vanadium, iron, copper and cobalt. After the cracking catalyst has become contaminated beyond an acceptable level, it may be desirable to be able to recover the passivating agents. It is thus another object of this invention to provide a method for recovering a passivating agent from a cracking catalyst which has become contaminated and substantially deactivated.

In accordance with the present invention, a method is provided whereby a suitable passivating agent is added to a cracking catalyst by contacting a cracking catalyst which has not been previously treated with a passivating agent with a refractory material which has been treated with the passivating agent. At least a portion of the passivating agent transfers by inter-particle transfer from the refractory material to the fresh cracking catalyst which has not been previously treated with the passivating agent. The passivating agent may be recovered from a cracking catalyst which has been treated with the passivating agent but which has become contaminated and substantially deactivated by mixing the treated, contaminated cracking catalyst with an untreated refractory material. At least a portion of the passivating agent will transfer from the contaminated catalyst to the untreated refractory material. However, the contaminants will not transfer from the contaminated catalyst to the untreated refractory material. Thus, an untreated refractory material such as fresh catalyst may be easily treated with passivating agents which are obtained from previously treated cracking catalysts which have become contaminated and deactivated.

Other objects and advantages of the invention will be apparent from the foregoing brief description of the invention and from the claims as well as from the detailed description which follows.

The cracking catalyst may be any of those cracking catalysts conventionally employed in catalytic cracking of hydrocarbons boiling above 204° C. for the production of gasoline, motor fuel blending components and light distillates. Such conventional cracking catalysts generally contain silica or silica-alumina in association with zeolitic materials. A particularly preferred cracking catalyst is a zeolite containing silica-alumina.

Any suitable passivating agent which can transfer by inter-particle transfer under suitable transfer conditions may be utilized in the present invention. Metals such as antimony, tin, indium and bismuth are known passivating agents and are considered to have the ability to transfer by inter-particle transfer. Antimony, tin or a combination of antimony and tin are particularly preferred as the passivating agent in the present invention.

Any antimony compound which provides passivation of contaminating metals deposited on a cracking catalyst can be utilized. Elemental antimony, inorganic antimony compounds, and organic antimony compounds as well as mixtures of any two or more thereof are suitable sources of antimony. The term "antimony" generally refers to any one of these antimony sources. Examples of some inorganic antimony compounds which can be used include antimony oxides such as antimony trioxide, antimony tetroxide, and antimony pentoxide; antimony sulfides such as antimony trisulfide and antimony pentasulfide; antimony selenides such as antimony triselenide; antimony tellurides such as antimony tritelluride; antimony sulfates such as antimony trisulfate; antimonic acids such as metaantimonic acid, orthoantimonic acid and pyroantimonic acid; antimony halides such as antimony trifluoride, antimony trichloride, antimony tribromide, antimony triiodide, antimony pentafluoride and antimony pentachloride; antimonyl halides such as antimonyl chloride and antimonyl trichloride; antimonides such as indium antimonide; and the like. Of the inorganic antimony compounds, those which do not contain halogen are preferred.

Examples of some organic antimony compounds which can be used include antimony carboxylates such as antimony triformate, antimony trioctoate, antimony triacetate, antimony tridodecanoate, antimony trioctadecanoate, antimony tribenzoate, and antimony tris(cyclohexanecarboxylate); antimony thiocarboxylates such as antimony tris(thioacetate), antimony tris(dithioacetate) and antimony tris(dithiopentanoate); antimony thiocarbonates such as antimony tris(0-propyl dithiocarbonate); antimony carbonates such as antimony tris(ethyl carbonate); trihydrocarbylantimony compounds such as triphenylantimony; trihydrocarbylantimony oxides such as triphenylantimony oxide; antimony salts of phenolic compounds such as antimony triphenoxide; antimony salts of thiophenolic compounds such as antimony tris(thiophenoxide); antimony sulfonates such as antimony tris(benzenesulfonate) and antimony tris(p-toluenesulfonate); antimony carbamates such as antimony tris(diethylcarbamate); antimony thiocarbamates such as antimony tris(dipropyldithiocarbamate), antimony tris(phenyldithiocarbamate) and antimony tris(butylthiocarbamate); antimony phosphites such as antimony tris(diphenyl phosphite); antimony phosphates such as antimony tris(dipropyl phosphate); antimony thiophosphates such as antimony tris(0,0-dipropyl thiophosphate) and antimony tris(0,0-dipropyl dithiophosphate) and the like. The last compound is also known as antimony tris(0,0-dipropyl phosphorodithioate), and is the presently preferred source of antimony, due in part to its solubility in hydrocarbons and its commercial availability. Mixtures of any two or more applicable substances comprising antimony can be employed.

Any tin compound which provides passivation of contaminating metals deposited on a cracking catalyst can be utilized. Preferably tin is used in combination with antimony. Elemental tin, inorganic tin compounds and organic tin compounds as well as mixtures thereof are suitable sources of tin. The term "tin" as used herein generally refers to any one of these tin sources. Examples of some inorganic tin compounds which can be used include tin oxides such as stannous oxide and stannic oxide; tin sulfides such as stannous sulfide and stannic sulfide; tin selenides such as stannous selenide and stannic selenide; tin tellurides such as stannous telluride; tin sulfates such as stannous sulfate and stannic sulfate; stannic acids such as metastannic acid and thiostannic acid; tin halides such as stannous fluoride, stannous chloride, stannous bromide, stannous iodide, stannic fluoride, stannic chloride, stannic bromide and stannic iodide; tin phosphates such as stannic phosphate; tin oxyhalides such as stannous oxychloride and stannic oxychloride; and the like. Of the inorganic tin compounds those which do not contain halogen are preferred as the source of tin.

Examples of some organic tin compounds which can be used include tin carboxylates such as stannous formate, stannous acetate, stannous butyrate, stannous octoate, stannous decanoate, stannous oxalate, stannous benzoate, and stannous cyclohexanecarboxylate; tin thiocarboxylates such as stannous thioacetate and stannous dithioacetate; dihydrocarbyltin bis(hydrocarbyl mercaptoalkanoate)s such as dibutyltin bis(isooctyl mercaptoacetate) and dipropyltin bis(butyl mercaptoacetate); tin thiocarbonates such as stannous 0-ethyl dithiocarbonate; tin carbonates such as stannous propyl carbonate; tetrahydrocarbyltin compounds such as tetrabutyltin, tetraoctyltin, tetradodecyltin, and tetraphenyltin; dihydrocarbyltin oxides such as dipropyltin oxide, dibutyltin oxide, dioctyltin oxide, and diphenyltin oxide; dihydrocarbyltin bis(hydrocarbyl mercaptide)s such as dibutyltin bis(dodecyl mercaptide); tin salts of phenolic compounds such as stannous thiophenoxide; tin sulfonates such as stannous benzenesulfonate and stannous p-toluenesulfonate; tin carbamates such as stannous diethylcarbamate; tin thiocarbamates such as stannous propylthiocarbamate and stannous diethyldithiocarbamate; tin phosphites such as stannous diphenyl phosphite; tin phosphates such as stannous dipropyl phosphate; tin thiophosphates such as stannous 0,0-dipropyl thiophosphate, stannous 0,0-dipropyl dithiophosphate and stannic 0,0-dipropyl dithiophosphate; dihydrocarbyltin bis(0,0-dihydrocarbyl thiophosphate)s such as dibutyltin bis(0,0-dipropyl dithiophosphate); and the like. Mixtures of any two or more applicable substances comprising tin can be employed. Dibutyltin bis(isooctyl mercaptoacetate) and stannic or stannous 0,0-dipropyl dithiophosphate are the tin-containing substances presently preferred, due in part to their solubility in hydrocarbons and their compatibility with antimony tris(0,0-dipropyl dithiophosphate). As a further advantage, the dibutyltin bis(isooctyl mercaptoacetate) is commercially available.

Any indium compound which provides passivation of contaminating metals deposited on a cracking catalyst can be utilized. Elemental indium, inorganic indium compounds, and organic indium compounds as well as mixtures of any two or more thereof are suitable sources of indium. The term "indium" generally refers to one of these indium sources. Suitable compounds of indium include for example, the indium oxides $In_2O_3$, InO, and $In_2O$; the indium sulfides, $In_2S_3$, InS, and $In_2S$; indium selenide; indium telluride; indium hydroxide; indium arsenide; indium phosphate; indium nitrate; and indium sulfate. Effective but less preferable indium compounds include indium perchlorate and the indium halides $InX_3$, $InX_2$, and InX where X can be chlorine, bromine or iodine. These indium compounds are less preferred because of the corrosive effect that such halogen compounds generally have on metal process equipment.

Any bismuth compound which provides passivation of contaminating metals deposited on a cracking catalyst can be utilized. Elemental bismuth, inorganic bismuth compounds, and organic bismuth compounds as well as mixtures of any two or more thereof are suitable sources of bismuth. The term "bismuth" generally refers to one of these bismuth sources. Suitable compounds of bismuth include, for example, the tellurides, sulfides, selenides and phosphates of bismuth.

Any suitable refractory material may be utilized to transfer the passivating agent either to or from a cracking catalyst. Materials such as clay, silica, alumina, and the like and mixtures of two or more thereof are suitable refractory materials. A fresh cracking catalyst which has been treated with a passivating agent is particularly preferred as a refractory material for transferring a passivating agent to an untreated cracking catalyst. A fresh untreated cracking catalyst is particularly preferred as a refractory material for mixing with a spent, treated catalyst to recover at least a portion of the passivating agents contained in or on the spent, treated catalyst.

The passivating agent may be added to the refractory material by any suitable method. The passivating agent may be added by dry mixing solids or by ion exchange. Ion exchange is generally restricted to zeolitic refractory materials and the quantity of the passivating agent which may be added to the refractory material by ion exchange generally is limited by the number of ions that are exchangeable. The passivating agent may be added to the refractory material by impregnating the refractory material with a solution containing the passivating agent. The solvent is then removed and the impregnated refractory material is then preferably heated in air to about 540° C. to decompose the passivating agent and fix the passivating agent to the refractory material.

Any suitable concentration of the passivating agent may be added to the refractory material. The refractory material may be treated to contain from about 0.1 to about 50 weight percent of the passivating agent based on the weight of the treated refractory material. Preferably, the concentration of the passivating agent will be in the range of about 0.1 to about 8 weight percent based on the weight of the treated refractory material.

Inter-particle transfer of the passivating agent from a refractory material to an untreated catalyst or from a previously treated catalyst which has become substantially deactivated to a refractory material requires an intimate mixing of the source and receiving refractory materials. Transfer is most effective when both the source and receiving refractory materials are finely divided. Transfer may be accomplished if only one of the materials is finely divided but the transfer will not be as effective. At least one of the refractory materials should have a diameter which is less than about 300 microns for efficient transfer to occur. Cracking catalysts typically contain about 50 weight percent of −200+325 mesh material with the balance being −325 mesh. Thus, about half of the cracking catalyst particles are in the 70–40 micron size and the balance has a diameter of less than 40 microns. Mixtures of particles in this range of sizes enables the transfer of the passivating agent efficiently.

The transfer of the passivating agent may be accomplished under any suitable transfer conditions. The transfer of the passivating agent is most effectively accomplished at temperatures in the range of about 425° C. to about 815° C. Generally, the time for the transfer will range from about 1 minute to about 150 minutes with a range of about 15 to about 60 minutes being more typical. Higher temperatures within the range of about 425° C. to about 815° C. will typically increase the rate of transfer of the passivating agent. Typically, at temperatures in the range of about 425° C. to about 815° C., the passivating agent is uniformly distributed on all of the refractory materials. Thus, the concentration of the passivating agent on the source material will be substantially equal to the concentration of the passivating agent on the receiving refractory material.

Generally, where the passivating agent is being transferred from a spent catalyst to an untreated catalyst, it will be desirable to separate spent catalysts from the fresh catalyst after a portion of the passivating agent has transferred from the spent catalyst to the fresh catalyst. It may also be desirable to separate the source and receiving materials when a refractory material other than a catalyst is utilized to transfer the passivating agent to an untreated catalyst. Where separation is desired, the source material used may have a different particle size than the receiving material. After exposure to conditions that permit the desired transfer of the passivating agent, the source and receiving materials can be separated by sieving, elutriation, cyclone separation and other similar techniques. If a spent catalyst is mixed with fresh catalyst, then magnetic means may be utilized to separate the spent catalyst and the fresh catalyst if the spent catalyst contains a sufficient concentration of ferro-magnetic material such as iron and nickel and certain compounds of iron and nickel.

The following example is presented in further illustration of the invention.

EXAMPLE

Inter-particle transfer of antimony and tin between catalysts A and B was demonstrated in the following manner. Catalyst A was fresh cracking catalyst (F-1000, manufactured by Filtrol Corp.). Catalyst B was prepared from a commercial cracking catalyst that had acquired contamination with vanadium, iron, and nickel during use. The contaminated commercial cracking catalyst was treated with antimony and tin as follows. To 40 g of the contaminated commercial cracking catalyst was added a solution that contained 2.31 g of Thermolite 31 (an oil soluble tin compound containing 18.1 weight percent tin) and 3.66 g of antimony tris (dipropylphosphorodithioate) (an oil soluble compound containing 11.0 weight percent antimony) in about 40 ml. of dry cyclohexane. After thorough mixing, the solvent was removed by evaporation and the resulting catalyst (Catalyst B) was transferred to a quartz reactor. Nitrogen was then introduced into the quartz reactor. While being fluidized with nitrogen, the catalyst in the quartz reactor was heated to 482° C. Nitrogen was replaced by hydrogen and heating continued to 649° C. After the temperature in the quartz reactor had reached 649° C., the quartz reactor was purged with nitrogen for five minutes. The catalyst in the quartz reactor was then fluidized for 15 minutes with air, and then purged with nitrogen while cooling to 482° C. Twelve cycles of reduction with hydrogen at 482° C. and oxidation at 649° C. followed. After cooling, catalyst B was mixed with an equal weight of catalyst A to produce catalyst AB.

Catalyst AB was divided into two equal portions. One portion was used in a confined fluidized bed to crack a gas oil through 100 cracking-regeneration cycles. Cracking was effected at about 510° C., regeneration at about 650° C., and a catalyst/oil ratio of about 6 was used. Some properties of the gas oil that was used in this run are: 29.0° API, 0.17 wt. % Ramsbottom carbon residue, <0.32 ppm Ni, <0.5 ppm V, <1 ppm Fe, 0.26 wt. % S, and 0.083 wt. % N. After this treatment the used catalyst (AB-used) and its counterpart (AB-unused) were processed separately to obtain a magnetic and non-magnetic fraction from each. The powdered catalysts were poured slowly over a permanent bar magnet inclined at 45° from the horizontal and mounted on a vibrating table. The rationale for this treatment was to retain on the magnet catalyst B, that was relatively rich in the ferromagnetic elements iron and nickel, while rejecting from the magnet catalyst A. The on-magnet and off-magnet fractions from AB-used and AB-unused were subjected to the magnetic treatment a second time in the hope of improving the separation. All four fractions together with catalyst A and catalyst B were analyzed for the elements that are shown in Table I.

TABLE I

| Element, Wt. % | Catalyst A | Catalyst B | AB-used, on-magnet | AB-used, off-magnet | AB-unused, on-magnet | AB-unused, off-magnet |
|---|---|---|---|---|---|---|
| Vanadium | <0.002 | 0.55 | 0.43 | 0.11 | 0.48 | 0.02 |
| Iron | 0.26 | 0.83 | 0.70 | 0.33 | 0.73 | 0.27 |
| Nickel | 0.007 | 0.35 | 0.31 | 0.03 | 0.33 | <0.01 |
| Tin | — | 0.85 | 0.53 | 0.44 | 0.71 | 0.03 |
| Antimony | <0.01 | 0.93 | 0.35 | 0.31 | 0.75 | 0.02 |

The magnetic separation is successful, as neither iron nor nickel experience significant inter-particle transfer under any of the conditions that the catalyst was subjected to. Comparison of analyses for catalyst A with "AB-unused, off-magnet" and of catalyst B with "AB-unused, on-magnet" shows that the magnet was quite effective to resolve unused catalyst AB into its components. The two fractions from AB-used were not resolved as cleanly. It is apparent, however, that the on-magnet fraction contains a much higher proportion of the contaminating metals vanadium, iron, and nickel than the off-magnet fraction contains.

A comparison of "AB-used, on magnet" with "AB-used off-magnet" shows that both antimony and tin have been transferred in significant concentrations from Catalyst B to Catalyst A under the cracking-regeneration conditions. A comparison of "AB-unused, on-magnet" with "AB-unused, off-magnet" shows that very little antimony and tin had transferred from Catalyst B to Catalyst A in the unused portion of Catalyst AB. Thus, simple mixing is not sufficient to promote transfer of the passivating agents. Suitable transfer conditions are also required.

Reasonable variations and modifications are possible by those skilled in the art within the scope of the described invention and the appended claims.

That which is claimed is:

1. A method for adding a suitable passivating agent, which has the capability to transfer by inter-particle transfer, to a cracking catalyst which has an insufficient concentration of said suitable passivating agent comprising the step of contacting said cracking catalyst under suitable transfer conditions with a suitable refractory material which contains a greater concentration of said suitable passivating agent than said cracking catalyst contains.

2. A method in accordance with claim 1 wherein said cracking catalyst which has an insufficient concentration of said suitable passivating agent is contacted with said suitable refractory material in the absence of a hydrocarbon containing feed stream.

3. A method in accordance with claim 1 wherein said suitable passivating agent is selected from the group consisting of elemental antimony, compounds of antimony, elemental tin, compounds of tin and mixtures of any two or more thereof.

4. A method in accordance with claim 3 wherein the concentration of said passivating agent on said suitable refractory material is in the range of about 0.1 to about 50 weight percent based on the weight of said suitable refractory material and said suitable passivating agent.

5. A method in accordance with claim 3 wherein the concentration of said suitable passivating agent on said suitable refractory material is in the range of about 0.1 to about 8 weight percent based on the weight of said suitable refractory material and said suitable passivating agent.

6. A method in accordance with claim 1 wherein said cracking catalyst which has an insufficient concentration of said suitable passivating agent is an untreated cracking catalyst.

7. A method in accordance with claim 6 wherein at least one of said untreated cracking catalyst and said suitable refractory material has a particle size which is less than about 300 microns.

8. A method in accordance with claim 6 wherein both said untreated cracking catalysts and said suitable refractory material have a particle size which is less than about 300 microns.

9. A method in accordance with claim 1 wherein said suitable transfer conditions comprise a temperature in the range of about 425° C. to about 815° C. and a contact time of said untreated cracking catalyst and said suitable refractory material in the range of about 1 minute to about 150 minutes.

10. A method in accordance with claim 1 wherein said suitable refractory material is a cracking catalyst.

11. A method for recovering a suitable passivating agent, which has the capability to transfer by inter-particle transfer, from a used cracking catalyst which has been previously treated with said suitable passivating agent but which has become catalytically less active than desired comprising the steps of:

contacting said used cracking catalyst under suitable transfer conditions with a suitable refractory material, which has a smaller concentration of said suitable passivating agent than is contained on said used cracking catalyst, to thereby effect the transfer of at least a portion of said suitable passivating agent contained on said used catalyst to said suitable refractory material; and separating the resulting used cracking catalyst having a depleted passivating agent content from the resulting suitable refractory material having an enriched passivating agent content.

12. A method in accordance with claim 11 wherein said suitable passivating agent is selected from the group consisting of elemental antimony, compounds of antimony, elemental tin, compounds of tin and mixtures of any two or more thereof.

13. A method in accordance with claim 11 wherein said suitable transfer conditions comprise a temperature in the range of about 425° C. to about 815° C. and a contact time of said used cracking catalyst and said suitable refractory material in the range of about 1 minute to about 150 minutes.

14. A method in accordance with claim 11 wherein at least one of said used cracking catalyst and said suitable refractory material has a diameter which is less than about 300 microns.

15. A method in accordance with claim 11 wherein both said used cracking catalyst and said suitable refractory material have a diameter which is less than about 300 microns.

16. A method in accordance with claim 11 wherein said suitable refractory material is a catalytically active cracking catalyst which has not been previously treated with said passivating agent.

17. A method in accordance with claim 11 wherein the particle size of said used cracking catalyst is different from the particle size of said suitable refractory material.

18. A method in accordance with claim 17 wherein said step of separating said used cracking catalyst from said suitable refractory material comprises sieving said used cracking catalyst and said suitable refractory material.

19. A method in accordance with claim 11 wherein said used cracking catalyst has become catalytically inactive because of the presence of ferro-magnetic material on said used cracking catalyst.

20. A method in accordance with claim 19 wherein said step of separating said used cracking catalyst from said suitable refractory material comprises exposing said used cracking catalyst and said suitable refractory material to a magnetic separation means.

* * * * *